US005870780A

United States Patent [19]

Prommer

[11] Patent Number: 5,870,780

[45] Date of Patent: Feb. 16, 1999

[54] COLLAPSIBLE STEAM CABIN FOR PERSONAL BODY CARE

[76] Inventor: Dietwin Helmut Prommer, Ahornstrasse 19, CH-8962, Bergdietikon, Switzerland

[21] Appl. No.: 734,697

[22] Filed: Oct. 21, 1996

[30] Foreign Application Priority Data

Oct. 20, 1995 [EP] European Pat. Off. ..... 95202845

[51] Int. Cl.[6] ..... A61H 33/06

[52] U.S. Cl. ..... 4/527; 4/531; 607/81; 607/83

[58] Field of Search ..... 4/524, 526, 527, 4/528, 529, 530, 531, 532; 607/81, 83, 84; 392/386, 394, 397, 398, 400, 401, 403, 405; 219/401, 402, 403; 220/338, 340

[56] References Cited

U.S. PATENT DOCUMENTS

| | | | |
|---|---|---|---|
| 1,464,093 | 8/1923 | Friedlander . | |
| 1,956,394 | 4/1934 | Merna | 4/531 |
| 2,233,326 | 2/1941 | Rooney | 220/340 |
| 3,092,843 | 6/1963 | Wright . | |
| 3,624,844 | 12/1971 | Sharps | 4/527 |
| 3,875,596 | 4/1975 | Noda . | |
| 4,031,573 | 6/1977 | Romanoff . | |
| 4,676,375 | 6/1987 | Willems et al. | 220/340 |

FOREIGN PATENT DOCUMENTS

| | | | |
|---|---|---|---|
| 1261105 | 9/1989 | Canada | 4/524 |
| 777.759 | 2/1935 | France . | |
| 1041115 | 9/1966 | United Kingdom | 4/532 |
| 1 240 839 | 7/1971 | United Kingdom . | |
| 89/06952 | 8/1989 | WIPO | 4/524 |
| 93/09752 | 5/1993 | WIPO | 4/524 |

*Primary Examiner*—Charles R. Eloshway
*Attorney, Agent, or Firm*—Young & Thompson

[57] ABSTRACT

A collapsible steam cabin for personal body care includes a bottom panel, having a front edge, rounded back edge and upstanding side edges, a rear panel which has a rounded lower edge which is slidingly connected to the rounded back edge, the back edge and the lower edge being contiguous, and a top edge the rear panel being rotatable around the back edge from a substantially vertical position to a position wherein the top edge is proximal to the front edge of the bottom panel forming a closed construction, a flexible material connected to the front edge of the bottom panel and the top edge of the back panel, and a connector for attachment to a steam generator. The cabin is in one embodiment provided with a connector having an integrated connector comprising a steam inlet valve and an electrical contact for connection to an external steam generator comprising a complementary connector.

9 Claims, 4 Drawing Sheets

COLLAPSIBLE STEAM CABIN FOR PERSONAL BODY CARE

FIELD OF THE INVENTION

The invention relates to a collapsible steam cabin for personal body care Comprising a bottom panel, a collapsible cabin wall and a steam generator.

BACKGROUND OF THE INVENTION

From U.S. Pat. No. 3,875,596, a portable sauna is known comprising a case with a front cover that is hingable for movement from a closed position to an open position. A collapsible seat is placed within the case as well as heating means. This construction has as a disadvantage that the placement of heating means inside the collapsible cabin, which is of relatively small dimensions, can cause the user to come in contact with the heating element. This may lead to the user getting burnt or suffering other discomfort from the heater. Also a part of the space available for the user is occupied by the heater element.

SUMMARY OF THE INVENTION

It is an object of the present invention to provide for a collapsible steam cabin which can be collapsed into relatively small dimensions and which is absolutely safe for a user. It is another object of the present invention to provide for a collapsible steam cabin that can be easily assembled and disassembled.

It is again another object of the invention to provide for a collapsible steam cabin which is of relatively low cost.

These objects are achieved by a steam cabin according to the invention comprising a bottom panel, a collapsible cabin wall having an aperture for projection of a user's head outside the cabin, and a steam generator. The steam cabin according to the invention can be easily assembled from its closed, box-like state to a ready-for-use position by hinging the back panel into an open position. By means of an aperture in the flexible wall, which unfolds when the back panel is put in its upright position, the user can enter into the steam cabin. As the steam generator is located outside the cabin, it can be of a compact construction, such that it can be easily transported or stowed away after use.

In one embodiment the steam generator comprises an integrated connector with an electrical contact element and a steam outlet valve for releasible connection to an extension apparatus comprising an integrated complementary connector having complementary electrical contact elements and a steam inlet valve, wherein the steam cabin comprises a similar complementary connector and is provided with a steam adjustment control located inside the cabin, which control is electrically connected to the complementary connector for adjustment of the steam production of the steam generator.

The steam generator can be connected to a number of different appliances such as steam irons, steam cleaning heads or steam pressure cleaning nozzles by use of the complementary electrical contact which is provided on all of these tools. By providing similar complementary electrical and steam connections on the outside of the collapsible cabin, this cabin can be connected to the external steam generator in the same way as the other appliances. When a steam generator for multipurpose household-use which is connectable to the above-mentioned appliances is already present, only a collapsible steam cabin needs to be purchased, such that the costs of the steam cabin can be kept at a relatively low level.

Inside the steam cabin, according to the present invention a control switch or dial is provided which is electrically connected to the electrical contact elements of the connector of the cabin. By operating this control, the amount of steam produced by the generator can be adjusted by the user from inside the cabin. The integrated connector with the steam inlet valve and the electrical contacts of the cabin can be very easily connected to the complementary connector of the steam generator. In this way the steam cabin can be unfolded and connected in a ready for use position with minimum effort.

Preferably the collapsible steam cabin comprises a bottom panel having a front edge, a back edge and two side edges, the cabin comprising a hinging U-shaped support comprising two side arms and a transverse arm, the side arms being with their ends hingingly connected proximate the back edge of the bottom panel, a rear panel being connected to the back edge of the bottom panel in a substantial vertical position, wherein the cabin wall comprises a flexible material of a predetermined length having two transverse ends, one transverse end being connected to the front edge and the side edges of the bottom panel, the other transverse end being connected to the three arms of the U-shaped support.

In this construction, the side walls are comprised of for instance a plastic sheet which is folded in harmonica-fashion onto the bottom panel. The user can take place in the steam cabin by stepping into the bottom panel, and lifting the U-shaped support, hinging it into a vertical position and connecting it to the rear panel. The cabin wall comprises near its upper end a slit or a hole through which the user can project its head outside the cabin.

Preferably the bottom panel comprises upstanding edges such that any vapour which condenses against the wall of the cabin is collected on the bottom panel and is contained thereby.

Preferably the steam cabin comprises a collapsible seat which is hingingly attached to the rear panel or the bottom panel. Preferably the collapsible seat automatically unfolds when the rear panel is placed in its vertical position.

In another preferred embodiment the connector of the steam generator or the complementary connector of the steam cabin is provided with a spring catch, the other connector being provided with a groove or a ridge for disengageable attachment to the spring catch.

In this way a secure mechanical connection between the connectors of the steam generator and the steam cabin is achieved. As the user of the steam cabin can not freely move due to restrictions of the side walls of the cabin, it is very uncomfortable if the connection between the steam generator and the cabin becomes detached. In order to prevent this situation, the spring catch is provided.

BRIEF DESCRIPTION OF THE DRAWINGS

The invention will be explained in detail with reference to the accompanying drawings. In the drawings.

DETAILED DESCRIPTION OF THE INVENTION

Figure 1:
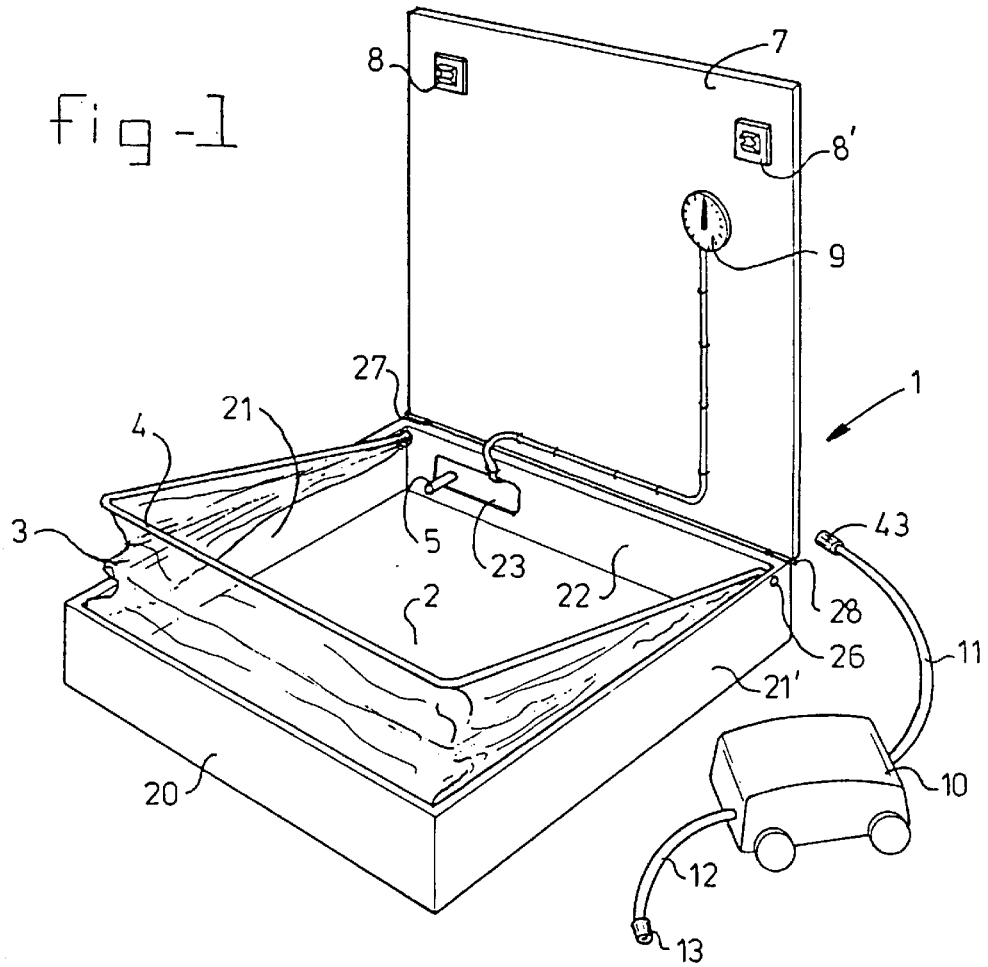
FIG. 1 shows a schematic perspective view of an embodiment of a collapsible steam cabin according to the present invention in its partly collapsed state.

FIG. 1 shows a collapsible steam cabin I comprising a bottom panel 2 having a front edge 2D, a back edge 22 and side edges 21, 21'. A rear panel 7 is vertically mounted against the bottom panel 2. A cabin wall 3, comprising a flexible sheet of material such as a mono- or a multi-layer of plastic material, an impregnated cloth or a combination thereof is connected between the edges 20, 21, 21' of the bottom panel 2 and a U-shaped support 4. The arms of the support 4 are at their free ends connected by means of hinges 26 proximate the back edge 22 of the bottom panel 2'. The lower transverse end of the flexible cabin wall 3 is connected to the front edge 20 and side edges 21, 21' of the bottom panel 2, whereas the upper transverse ends are connected to the legs of the U-shaped support 4. In the back edge 22 a steam inlet 5 is provided. The rear panel 7 is vertically connected with the bottom panel 2 via hinges 27, 28 and comprises two connection devices 8, 8' for receiving the U-shaped support arm 4. The connection devices 8, 8' may comprise a magnet, the support arm 4 in that case being made of a metal. Alternatively the connection devices may comprise devices such as VELCRO® tapes, press buttons, or other devices. A control 9 is connected to the rear panel 7 and is electrically connected with a connector 23, which is placed against the outside of the back edge 22 of the bottom panel 2. By turning the control 9, the steam generation of an external steam generator 10 can be adjusted from inside the steam cabin 1.

The steam generator 10 comprises a multipurpose device such as sold by Intertec, Switzerland under the tradename DAMPF ELEFANT. The steam generator 10 comprises a lead 11 through which a steam supply and an electrical supply are connected to the connector 43. The connector 43 can be connected to the complementary connector 23 of the steam cabin 1. The steam generator 10 is powered by means of a lead 12 and a plug 13 by an external source of electricity.

Figure 2:
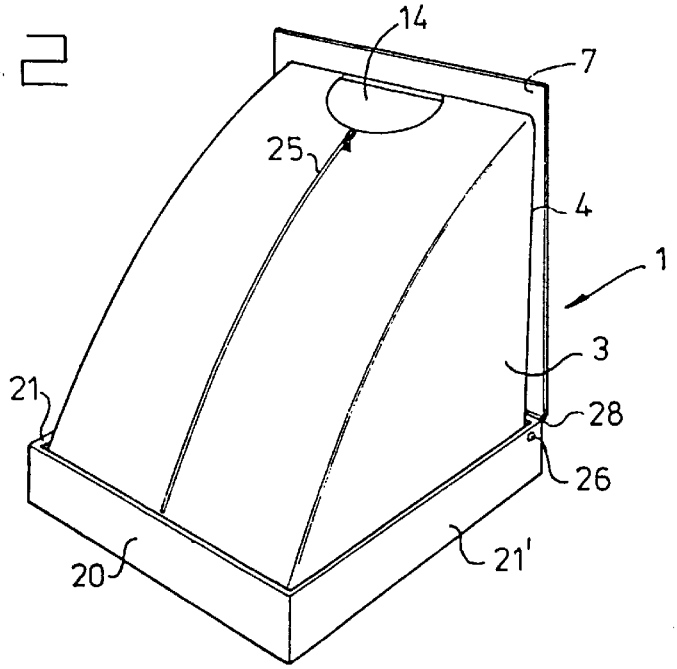
FIG. 2 shows the steam cabin of FIG. 1 in its assembled state.

FIG. 2 shows the steam cabin 1 in its assembled state. The U-shaped support 4 is placed in a vertical position, adjacent to the rear panel 7. The support 4 is maintained in its upright position by the connection means 8,8'. In the upper part of the cabin wall 3 a hole 14 is provided which surrounds the neck of a user when positioned inside the cabin. The cabin wall comprises a zip closure 25 which can be opened and closed from inside the cabin 1.

Figure 3:
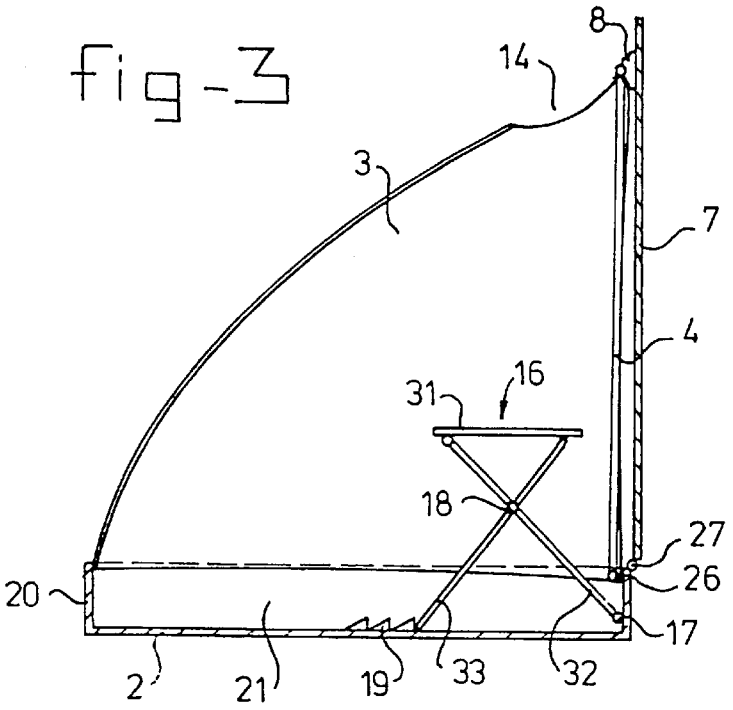
FIG. 3 shows a schematic side view illustrating an embodiment of a collapsible seat mechanism of the steam cabin according to the present invention.

FIG. 3 shows a side view of the cabin 1, the cabin wall 3 being removed for illustrative purposes. A foldable chair 16 is connected in a hinge point 17 to the rear panel 7. The seat 31 of the chair 16 is hingingly connected to a first leg 32. A second leg 33 is hingingly connected in hinge point 18 to the first leg 32. The bottom of the second leg 33 rests against an abutment 19 on bottom panel 2. By lifting the leg 33 free from the abutment 19, the legs 32 and 33 can be placed in parallel with the bottom plate 2 and the chair 16 is in this way folded into a flattened position wherein it lies below the side edges 21, 21' the back edge 22 and the front edge 20.

The steam generator 10 comprises at the end of its electrical lead/steam supply lead 11 a connector 43 having electrical contact elements and a steam outlet valve. This connector is connectable to a number of different appliances, each comprising a steam inlet valve and complementary electrical connections. Such appliances comprise steam irons, steam cleaning brushes, steam spraying nozzles, and the like.

Figure 4:
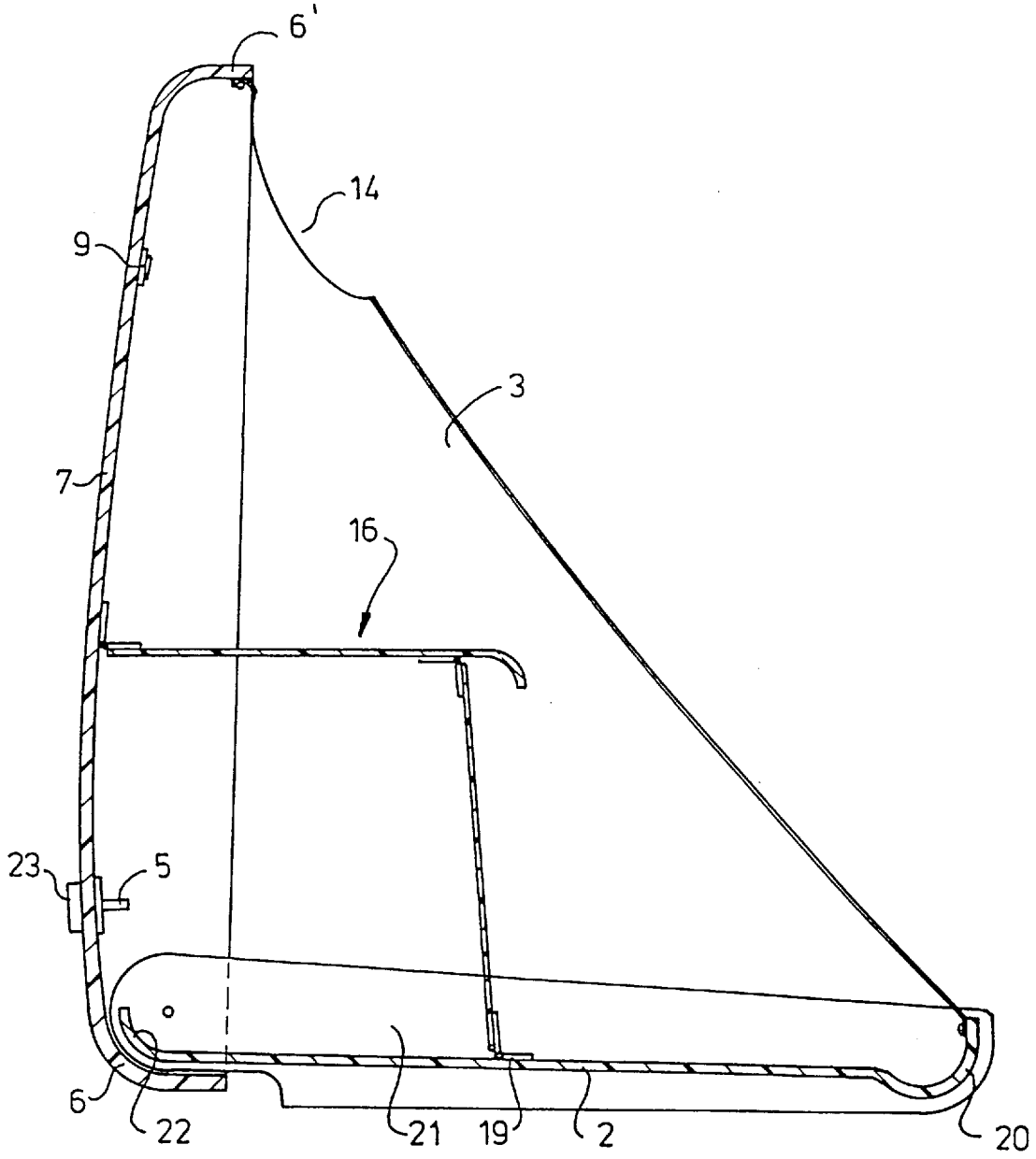
FIG. 4 shows a cross-sectional view of a preferred embodiment of a steam cabin according to the present invention in its ready-for-use position.

FIG. 4 shows a preferred embodiment of a steam cabin wherein the rear panel 7 has a rounded lower edge 6 which is connected to the back edge 22 of the bottom panel 2. The back edge 22 (of the bottom panel 2) is also rounded and can slide against the rounded lower edge 6 of the rear panel 7. The flexible cloth or sheet of the flexible wall 3 is connected to the top edge 6' of the rear panel 7 and to the front edge 20 of the bottom panel 2. A collapsible seat 16 is hingingly connected to the rear panel 7 and rests with one hinging leg against abutment 19.

Figure 5:
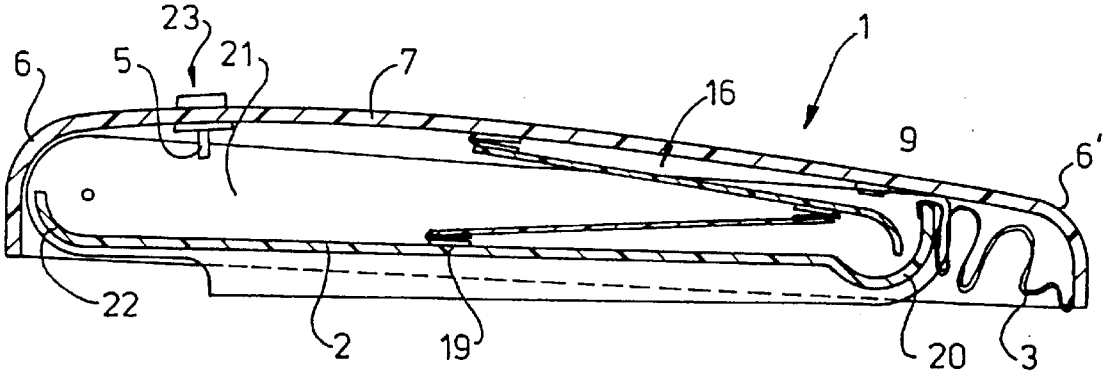
FIG. 5 shows the steam cabin of FIG. 4 in its collapsed position, ready for storage or transportation.

As shown in FIG. 5, the rear panel 7 can be hinged into a substantially horizontal position wherein it overlies the bottom panel 2. In this way a box-like construction is formed comprising on its inside the collapsed seat 16 and the flexible wall 3. The cabin 1 can in its collapsed state easily be transported or stored and provides an attractive appearance. The bottom panel 2 and the rear panel 7 are in this embodiment preferably made of wood. A recess is provided along the top edge 6' of the rear panel 7 wherein some material of the rear panel has been cut away for providing a clearance around the user's neck while projecting his head outside the steam cabin during use.

Figure 6:
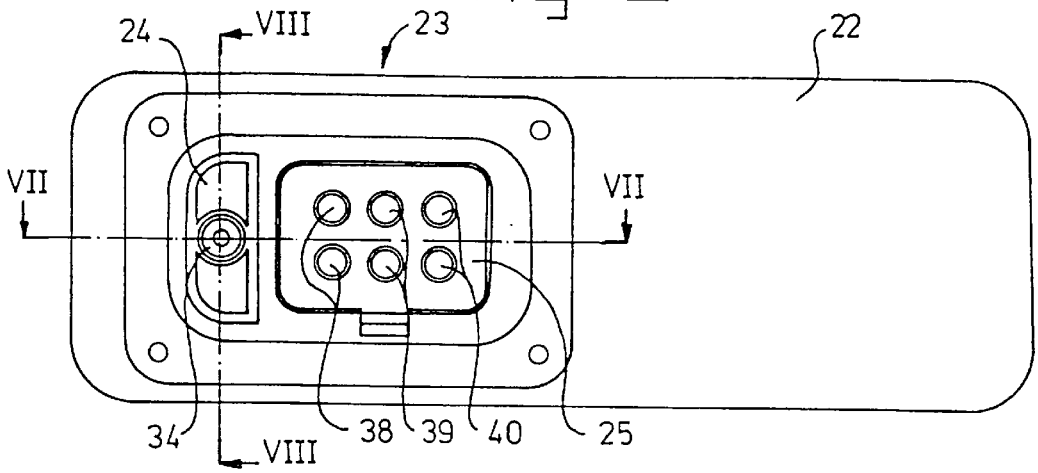
FIG. 6 shows a rear view of the bottom panel of the steam cabin showing the complementary connector of the steam cabin with integrated steam valve and electrical connections.

As appears in FIG. 6 the connector 23 of the steam cabin 1, (and of all the above appliances) comprises the steam inlet valve 24 and the electrical connections 25, and is placed against the back edge 22 of the bottom panel 2. FIG. 6 shows a plan view of the back panel 22 of the bottom panel 2 of the steam cabin. The steam inlet valve 24 and the electrical connection 25 are placed in an integrated unit, and can be simultaneously coupled to a complementary connector 43 which is provided at the end of the electrical lead/steam supply 11 of steam generator 10.

Figure 7:
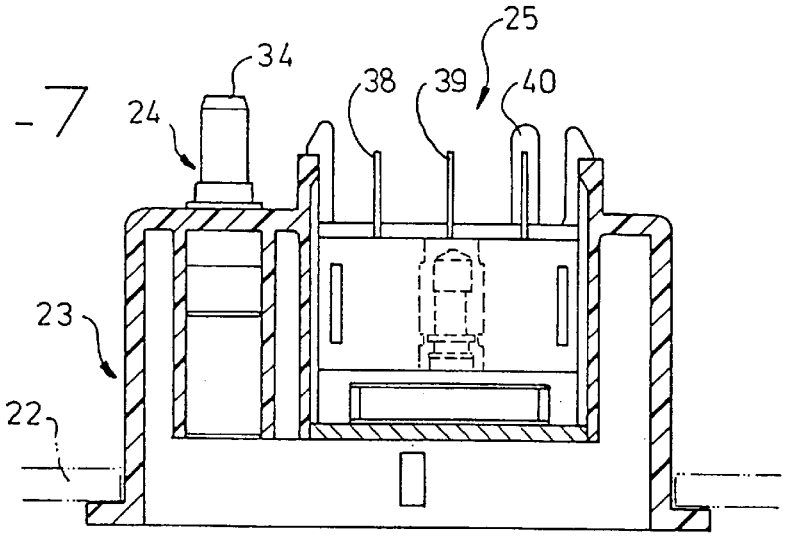
FIG. 7 shows a cross-sectional view along the line VII—VII, of the connector of FIG. 6.

FIG. 7 shows a cross-sectional view along the line VII—VII in FIG. 6 and shows the steam inlet valve 24, having a steam inlet 34 that is located inside the steam cabin 1.

Figure 8:
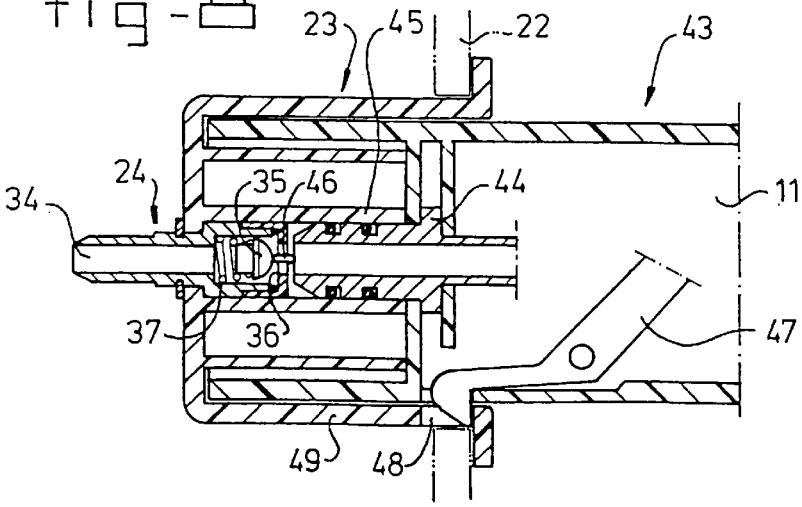
FIG. 8 shows a cross-sectional view along the line VIII—VIII of the connector of FIG. 6 and also shows the spring catch of the connector of the steam generator and the steam cabin according to the invention.

As can be seen in FIG. 8, the steam inlet valve 24 comprises a spring mounted valve 35 that closes off the entrance of the inlet 34. The valve 35 comprises a semicircular closure which is pressed against an inlet opening 36 by a spring 37. Next to the steam inlet 34, the electrical contact 25 is placed comprising a live electrical contact 38, an earth contact 39 and a neutral contact 40.

FIG. 8 shows how a complementary connector 43 placed at the end of the electrical lead/steam supply 11 that is connected to the steam generator 10 engages with the connector 23. A steam outlet 44 is inserted into the cylindrical guide element 45. The steam outlet 44 comprises at its end a projection 46 which engages with the spring mounted valve 45. Hereby the steam inlet aperture 46 is opened. A spring mounted catch 47 engages with a groove 48 located in the housing 49 of the connector 23.

The electrical contacts 38, 39 and 40 of the connector 23 form an electrical connection between the control 9 inside the steam cabin and the external steam generator 10. By turning the control 9, the steam generation of the steam generator 10 can be electrically adjusted from inside the steam cabin.

The present invention relates to a steam cabin which is made of a specially constructed and easily collapsible construction which is of relatively small dimensions and can therefore be transported and stored in many places. The steam cabin operates in connection with an external steam generator for instance as marketed by the Intertec group of Switzerland.

Conventional saunas work with the so-called "heat principle" in which heat is generated by means of an electrical or wood fire. The high temperatures in conventional saunas, which may range up to 100° C. in combination with a low humidity is for many people uncomfortable.

Rather then generating high temperatures, in the steam cabin according to the present invention steam is fed into the steam cabin from an external steam generator, such that the body is not exposed to unduly high temperatures. Hence the steam cabin according to the present invention is for instance particularly suitable for body building. The steam cabin according to the present invention has many applications such as home use, use at a campsite, in hotels, hospitals, sports, fitness and health clubs, etcetera. The cabin may be fit an inbuilt seat or can made accessible for wheel chairs.

I claim:

1. Collapsible steam cabin (1) for personal body care comprising a bottom panel (2), a collapsible cabin wall (3) having an aperture (14) for projection of a user's head outside the cabin, and a steam generator (10), wherein the steam generator (10) includes an integrated connector (43) having an electrical contact element and a steam outlet for passing steam generated by the steam generator through the connector (43), an extension apparatus mounted on the cabin for releasable connection with the integrated connector (43) comprising an integrated complementary connector (23) having complementary electrical contact elements and a complementary steam inlet valve for passing steam from the steam outlet to the interior of the cabin, the cabin being provided with a steam adjustment control (9) located inside the cabin, which control is electrically connected to the complementary connector (23) of the cabin for adjustment of the steam production of the steam generator (10).

2. Collapsible steam cabin (1) according to claim 1, wherein the bottom panel (2) comprises a front edge (20), a back edge (22) and two side edges (21, 21'), the cabin comprising a hinging U-shaped support (4) comprising two side arms and a transverse arm, the side arms being with their ends (27, 28) hingingly connected proximate the back edge (22) of the bottom panel (2), a rear panel (7) being connected to the back edge (22) of the bottom panel (2), wherein the cabin wall (3) comprises a flexible material of predetermined length having two transverse ends, a lower transverse end (29) being connected to the front edge (20) and the side edges (21, 21') of the bottom panel (2), the upper transverse end (30) being connected to the three arms of the U-shaped support (4).

3. Collapsible steam cabin (1) according to claim 1, wherein the connector (43) of the steam generator (10) is provided with a spring catch (47) and the complementary connector is provided with a groove (48) for disengageable attachment to the spring catch (47).

4. Collapsible steam cabin for personal body care, comprising:

a bottom panel having a front edge, a back edge and upstanding side edges;

a rear panel having a lower edge which is hingedly connected to the back edge, and a top edge, the rear panel being hingable with respect to the bottom panel from a substantially vertical position to a position wherein the top edge is proximal to the front edge of the bottom panel and forms a closed construction;

a flexible material connected to the front edge of the bottom panel and the top edge of the back panel;

a steam generator including an integrated connector having an electrical contact element and a steam outlet for passing generated steam through the integrated connector;

an extension apparatus mounted on the cabin for releasable connection with the integrated connector and comprising a complementary connector having complementary electrical contact elements and a steam inlet valve for passing steam from the steam outlet to the interior of the cabin;

a steam adjustment control located inside the cabin, said control being electrically connected to the complementary connector of the cabin for adjustment of steam produced by the steam generator.

5. Collapsible steam cabin for personal body care, according to claim 4, wherein the back edge is rounded, the rear panel has a lower edge which is slidingly connected to the rounded back edge, and said back edge and lower edge being contiguous.

6. Collapsible steam cabin according to claim 4, wherein the rear panel has along its top edge a recess for accommodating a user's neck when seated in the cabin while projecting his head outside the cabin.

7. Collapsible steam cabin according to claim 4, wherein the bottom panel includes upstanding edges.

8. Collapsible steam cabin according to claim 4, further comprising a collapsible seat connected to at least one of the bottom panel and the rear panel.

9. Collapsible steam cabin according to claim 4, wherein one of the connector of the steam generator and the complementary connector is provided with a spring catch and the other of the connector of the steam generator and the complementary connector is provided with a groove for disengageable attachment to the spring catch.

* * * * *